US006784604B2

(12) United States Patent
Niiyama et al.

(10) Patent No.: US 6,784,604 B2
(45) Date of Patent: Aug. 31, 2004

(54) FIELD EMISSION ELEMENT AND METHOD FOR MANUFACTURING THE SAME

(75) Inventors: Takahiro Niiyama, Chiba (JP); Mitsuru Tanaka, Chiba (JP); Yuji Obara, Chiba (JP)

(73) Assignee: FutubaCorporation, Chiba (JP)

( * ) Notice: Subject to any disclaimer, the term of this patent is extended or adjusted under 35 U.S.C. 154(b) by 5 days.

(21) Appl. No.: 10/405,703

(22) Filed: Apr. 3, 2003

(65) Prior Publication Data

US 2003/0189396 A1 Oct. 9, 2003

(30) Foreign Application Priority Data

Apr. 8, 2002 (JP) ..... 2002-105871

(51) Int. Cl.[7] ..... H01J 1/02
(52) U.S. Cl. ..... 313/309; 313/495
(58) Field of Search ..... 313/495, 309, 313/336, 351

(56) References Cited

U.S. PATENT DOCUMENTS 6,727,642 B1 * 4/2004 Cho et al. ..... 313/309

* cited by examiner

*Primary Examiner*—Vip Patel
(74) *Attorney, Agent, or Firm*—Bacon & Thomas PLLC

(57) ABSTRACT

A field emission element includes a substrate, a cathode conductor disposed on the substrate, an insulating layer structure on the cathode conductor that has a first insulating layer on the cathode conductor and a second insulating layer on the first insulating layer, a gate disposed on the second insulating layer, a gate hole provided through the gate and the insulating layer structure to expose a portion of the cathode conductor therethrough, and an emitter on the exposed portion of the cathode conductor in the gate hole. The first insulating layer is covered by the second insulating layer at a side surface of the gate hole and a dielectric constant of the first insulating layer is different from that of the second insulating layer.

7 Claims, 8 Drawing Sheets

FIELD EMISSION ELEMENT AND METHOD FOR MANUFACTURING THE SAME

FIELD OF THE INVENTION

The present invention relates to a field emission element for use in a field emission display (FED) and method for manufacturing the same.

BACKGROUND OF THE INVENTION

Conventional field emission elements and a method for manufacturing same as disclosed in Japanese patent No. 2636630 will now be illustrated with reference to FIGS. 3A to 4E.

FIGS. 3A and 3B present a top view of field emission elements and an expanded cross-sectional view of a portion X in FIG. 3A, respectively.

Referring to FIG. 3B, a field emission element includes a glass substrate 10, on which a cathode conductor 11, an insulating layer 12 and a gate 13 are disposed. Provided in the insulating layer 12 and the gate 13 is a gate hole 131, in which a conical emitter 14 is formed on the cathode conductor 11 exposed in the bottom portion of the gate hole 131. Additionally, a resistance layer may be disposed between the emitter 14 and the cathode conductor 11.

The gate 13 is made of a metal such as molybdenum (Mo) and niobium (merely abbreviated as Nb), whereas the emitter 14 is made of a metal such as Mo.

The method for manufacturing the field emission element of FIGS. 3A and 3B will now be described with reference to FIGS. 4A to 4E.

The cathode conductor 11, the insulating layer 12 and the gate 13 are laminated on the glass substrate 10 as shown in FIG. 4A. A photo-resist layer (not shown) is deposited on the gate 13 and are patterned, and then the gate 13 and the insulating layer 12 are etched, to thereby provide gate holes 131, as shown in FIG. 4B. Thereafter, a peeling layer 15 of nickel (Ni) or aluminum (Al) is formed on the surface of the gate 13 by an oblique vapor deposition as shown in FIG. 4C, by which neither Ni nor Al is deposited on the bottom portion of the gate hole 131. Then, the emitter 14 is formed by depositing a material for the emitter 14, i.e., Mo, on the surface of the peeling layer 15 and also toward the gate hole 131 at a right angle with respect to the glass substrate 10 as shown in FIG. 4D. Through such vertical vapor deposition, a Mo layer 16 is formed on the peeling layer 15 and the conical emitter 14 is formed within the gate hole 131. The formation of the conical emitter 14, which conically fills the gate hole 131, is a result of a gradual decrease of hole diameter during the growth of the Mo layer 16 above the gate hole 131. Thereafter, the peeling layer 15 and the Mo layer 16 are removed to complete formation of the field emission element as shown in FIG. 4E.

In a field emission display, by applying a voltage equal to or less than an anode voltage to the gate 13, emission of the electrons from the emitter 14 can be controlled. Therefore, the voltage applied to the gate 13 must be reduced in order to reduce the level of the driving voltage of the field emission display. To accomplish this, the distance d1 (shown in FIG. 3B) between the gate 13 and the tip of the emitter 14 needs to be small, which can be achieved by reducing the diameter of the gate hole 131. The diameter of the gate hole 131 is determined when the gate hole 131 is formed by an etching process shown in FIG. 4B.

In the process shown in FIG. 4B, a photomask aligner, an electron beam exposure apparatus or an ion beam exposure apparatus can be used to form the gate hole 131. The photomask aligner can be advantageous in reducing time in a patterning process by patterning a large area, e.g., 50 mm×50 mm, at a time, but this device is less suitable in forming a gate hole having a diameter equal to or less than 1 μm. On the other hand, the electron beam exposure apparatus and the ion beam exposure apparatus are more suitable in forming gate holes having a diameter less than 1 μm, but offer a limited patterning area, e.g., 1 mm×1 mm, at a time, thereby requiring greater processing time.

The correlation between the diameter d2 of the gate hole 131 and the height h1 of the corresponding emitter 14 will now be illustrated. When the diameter d2 of the gate hole 131 is reduced, the height h1 of the emitter 14 is also reduced. As evident from the process shown in FIG. 4D, the emitter 14 grows until the gate hole 13 is clogged or covered, and such growth depends on the diameter d2 of the gate hole 131. Additionally, the aspect ratio (the ratio of the height h1 to the diameter of the bottom of the emitter 14) depends on selection of the material of the emitter 14 and conditions for forming the layer. Consequently, a smaller diameter d2 of the gate hole 131 with other conditions fixed, yields a smaller height of the emitter 14.

With reference to FIG. 3B, if the diameter d2 of the gate hole 131 is reduced, while holding the height h2 of the insulating layer 12 fixed, the height h1 of the emitter 14 is also reduced. Consequently, the tip of the emitter 14 is displaced farther from the gate 13, lengthening the distance d1 between the gate 13 and the emitter 14. Therefore, in order to reduce the level of voltage applied to the gate 13, the tip of the emitter 14 needs to be closer to the gate 13 by reducing the height h2, i.e., thickness, of the insulating layer 12, while reducing the diameter d2 of the gate hole 131.

In such a case, when the insulating layer 12 becomes thinner, electrostatic capacity of a capacitor formed by the cathode conductor 11 and the gate 13 becomes greater and reactive power also becomes greater. To reduce the reactive power, an insulation material of smaller dielectric constant can be chosen for the insulating layer 12, but the smaller dielectric constant in general induces low breakdown voltage.

Referring to FIG. 5, there are plotted dielectric constants and the breakdown voltages of silicon based insulating materials formed into layers by the CVD process. In general, an insulating material of a lower dielectric constant has a lower breakdown voltage than that of a higher dielectric constant as shown in FIG. 5. Therefore, the reactive power may be reduced by employing the insulating layer 12 made of insulating material with a lower dielectric constant, however, it suffers from a reduction in the breakdown voltage.

SUMMARY OF THE INVENTION

It is, therefore, an object of the present invention to provide a field emission element having a structure which is capable of lowering a driving voltage by reducing a diameter of a gate hole, reducing a reactive power between a gate and a cathode conductor and raising breakdown voltage, and a method for manufacturing such a field emission element, which is capable of providing the gate hole with a diameter equal to or less than 1 μm through the use of a photomask aligner.

In accordance with one aspect of the present invention, there is provided a field emission element, including: a substrate made of an insulating material; a cathode conductor disposed on the substrate; an insulating layer structure disposed on the cathode conductor wherein the insulating layer structure includes a first insulating layer formed on the cathode conductor and a second insulating layer formed on the first insulating layer; a gate disposed on the second insulating layer; a gate hole provided through the gate and the insulating layer structure to expose a portion of the cathode conductor therethrough; and an emitter of a conical shape formed on the exposed portion of the cathode conductor in the gate hole, wherein the first insulating layer is covered by the second insulating layer at a side surface of the gate hole and a dielectric constant of the first insulating layer is different from that of the second insulating layer.

In accordance with another aspect of the invention, there is provided a field emission display, including: a field emission element, having: a substrate made of an insulating material; a cathode conductor disposed on the substrate; an insulating layer structure disposed on the cathode conductor wherein the insulating layer structure includes a first insulating layer formed on the cathode conductor and a second insulating layer formed on the first insulating layer; a gate disposed on the second insulating layer; a gate hole provided through the gate and the insulating layer structure to expose a portion of the cathode conductor therethrough; and an emitter of a conical shape formed on the exposed portion of the cathode conductor in the gate hole, wherein the first insulating layer is covered by the second insulating layer at a side surface of the gate hole and a dielectric constant of the first insulating layer is different from that of the second insulating layer.

In accordance with still another aspect of the invention, there is provided a method for manufacturing a field emission element, including the steps of: forming a cathode conductor on a substrate made of an insulating material; forming a first insulation layer on the cathode conductor; providing a gate hole in the first insulating layer, the cathode conductor being exposed through the gate hole; forming a second insulating layer on the first insulating layer, the cathode conductor exposed in a bottom portion of the gate hole and a side surface of the gate hole; forming a gate on the second insulating layer outside the gate hole; forming a peeling layer on the gate; removing the second insulating layer on the cathode conductor exposed in the bottom portion of the opening; forming a conical emitter by depositing a material for the emitter on the peeling layer and on the cathode conductor in the gate hole; and removing the peeling layer, wherein a dielectric constant of the second insulating layer is different from that of the first insulating layer.

BRIEF DESCRIPTION OF THE DRAWINGS

The above and other objects and features of the present invention will become apparent from the following description of the preferred embodiment given in conjunction with the accompanying drawings, in which.

DETAILED DESCRIPTION OF THE PREFERRED EMBODIMENTS

Figure 1A:
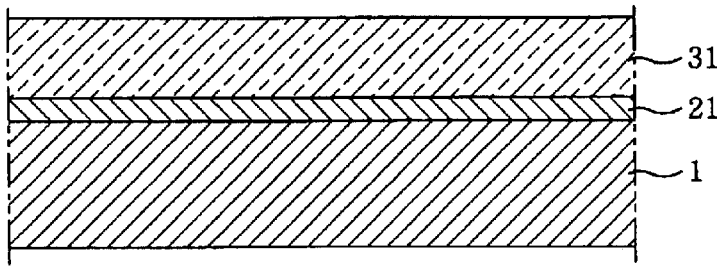
FIGS. 1A to 1G illustrate manufacturing steps involved in a method for manufacturing a field emission element in accordance with the preferred embodiment of the present invention.

The preferred embodiment of the present invention will now be described with reference to FIGS. 1A to 2. Like parts will be represented with like reference numerals.

Referring to FIGS. 1A to 1G, there are illustrated manufacturing steps involved in a method for manufacturing a field emission element in accordance with the preferred embodiment of the present invention.

Figure 1B:
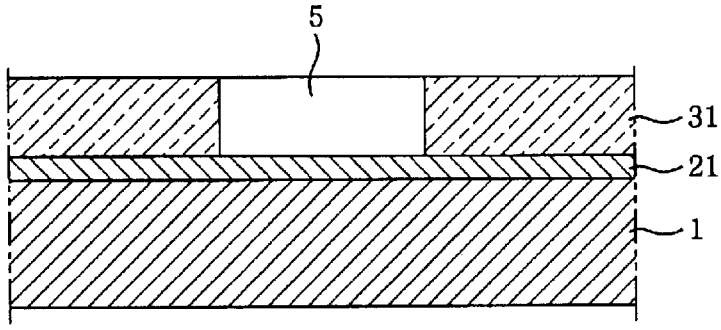
Figure 1C:
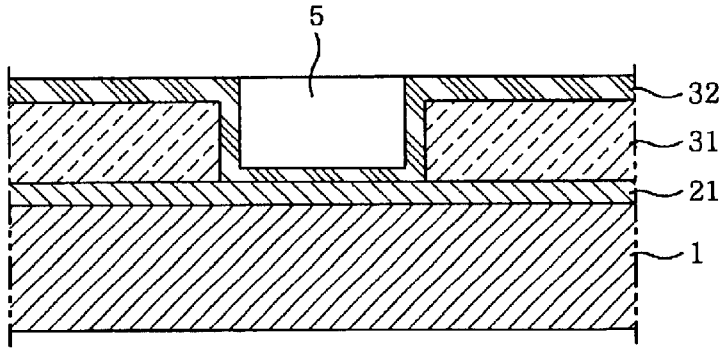
Figure 1D:
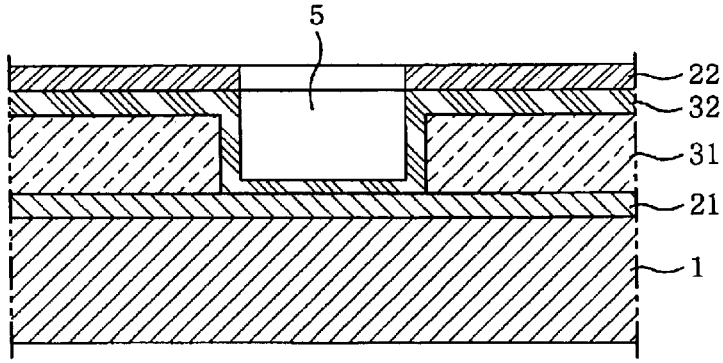
Figure 1E:
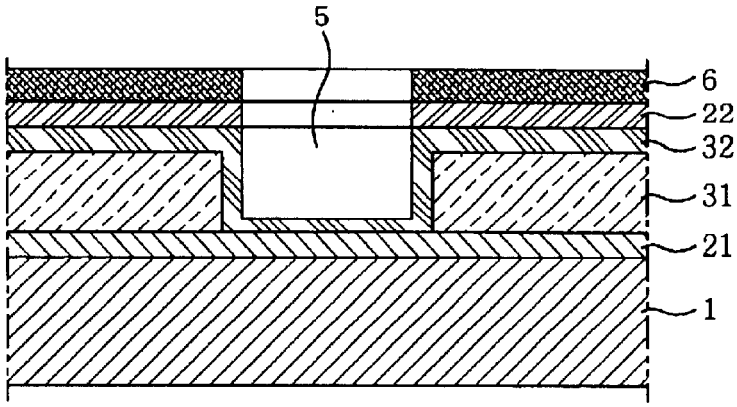
Figure 1F:
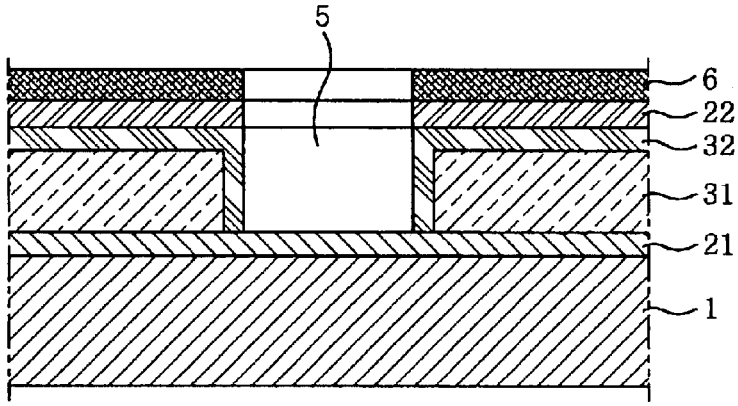
Figure 1G:
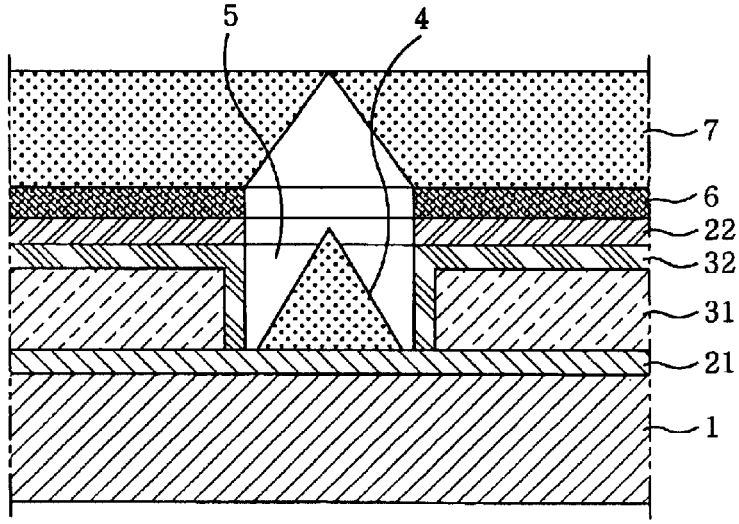
Figure 2:
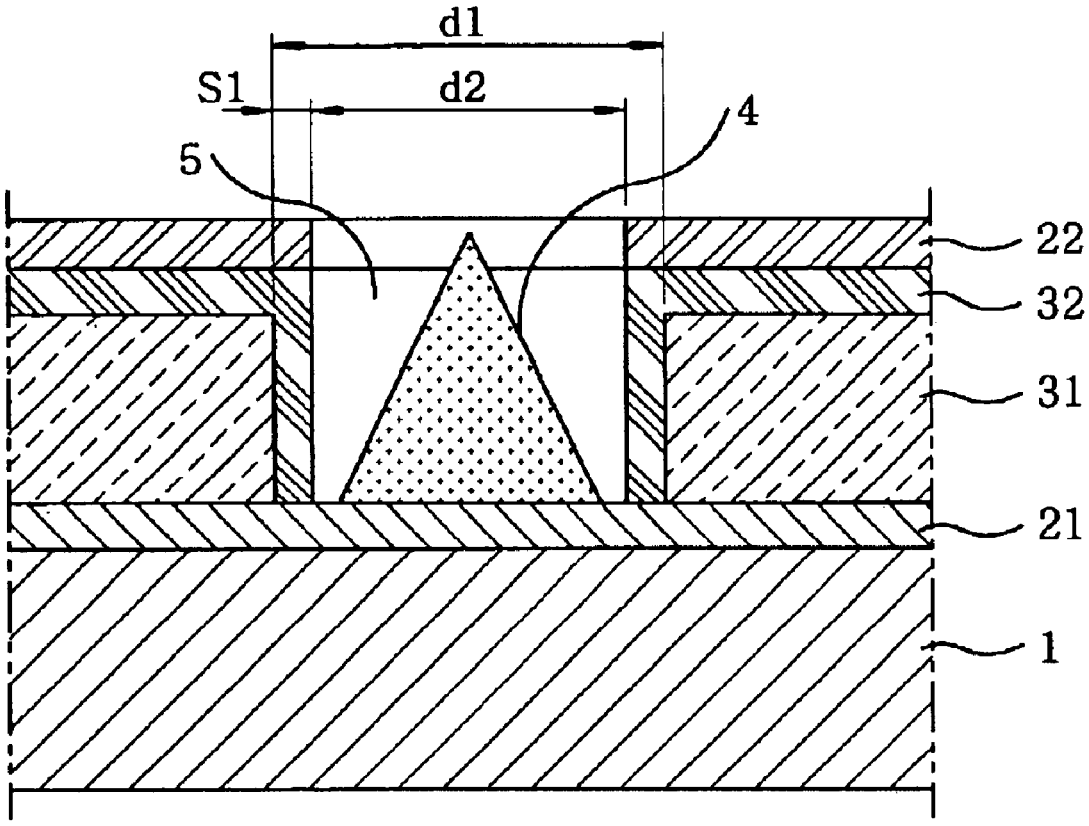
FIG. 2 presents a schematic cross sectional view of the field emission element fabricated in accordance with the preferred embodiment of the present invention shown in FIGS. 1A to 1G.
Figure 3A:
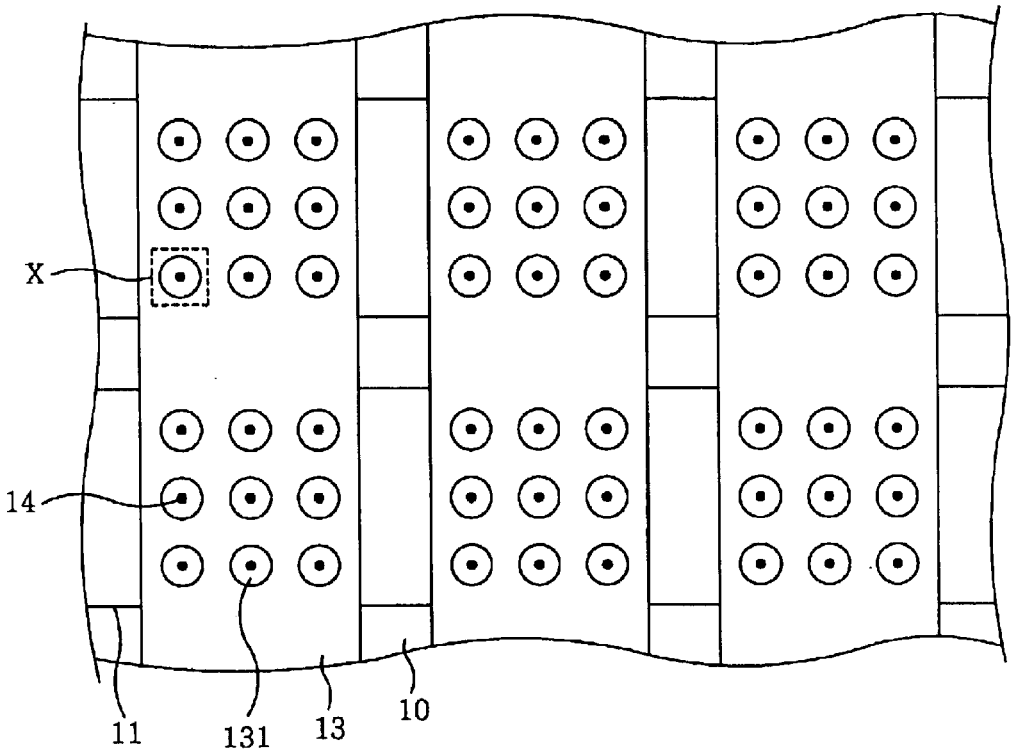
FIG. 3A (PRIOR ART)
FIGS. 3A and 3B depict a top view of field emission elements and an expanded cross-sectional view of a portion X in FIG. 3A, respectively.
Figure 3B:
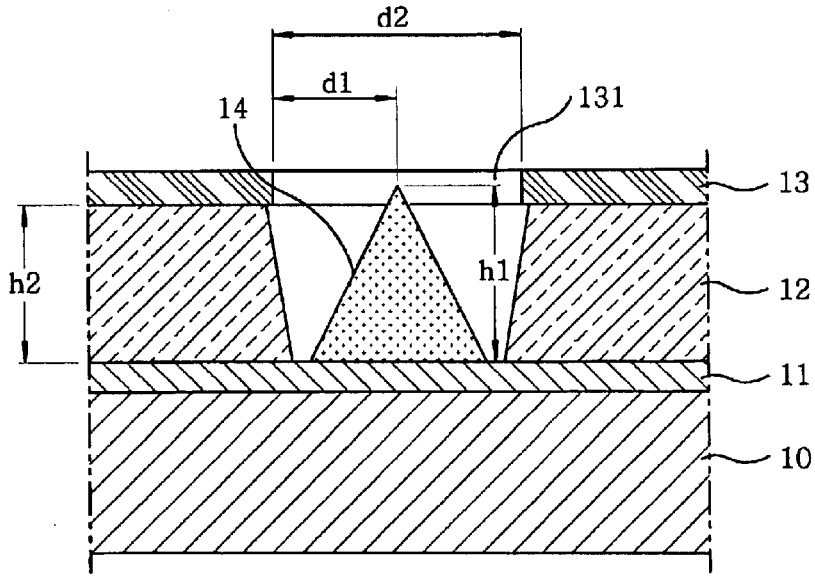
FIG. 3B (PRIOR ART)
Figure 4A:
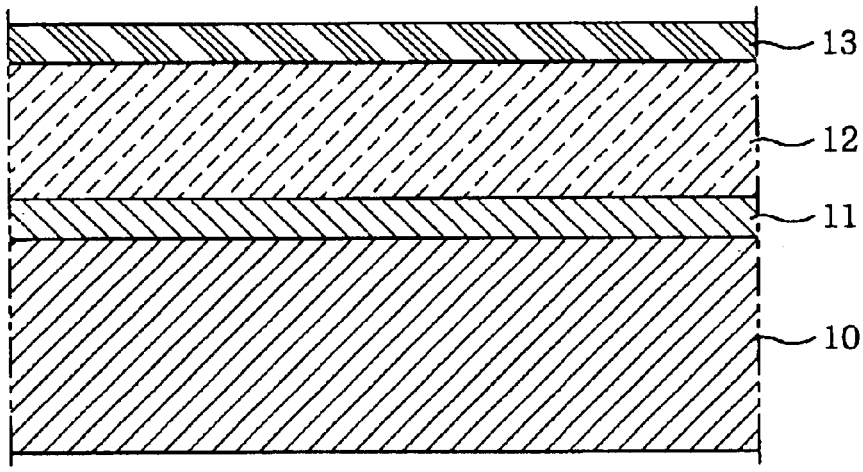
FIG. 4A (PRIOR ART)
FIGS. 4A to 4E offer manufacturing steps involved in a method for manufacturing a conventional field emission element.
Figure 4B:
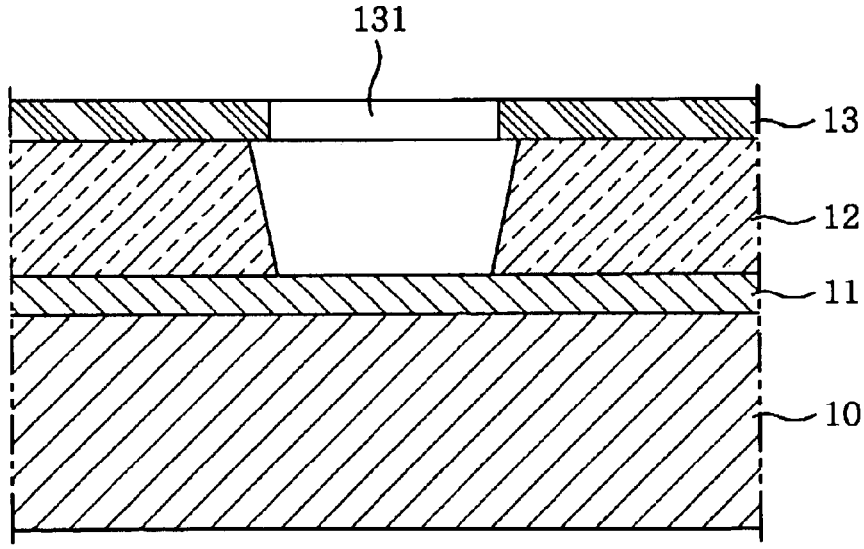
FIG. 4B (PRIOR ART)
Figure 4C:
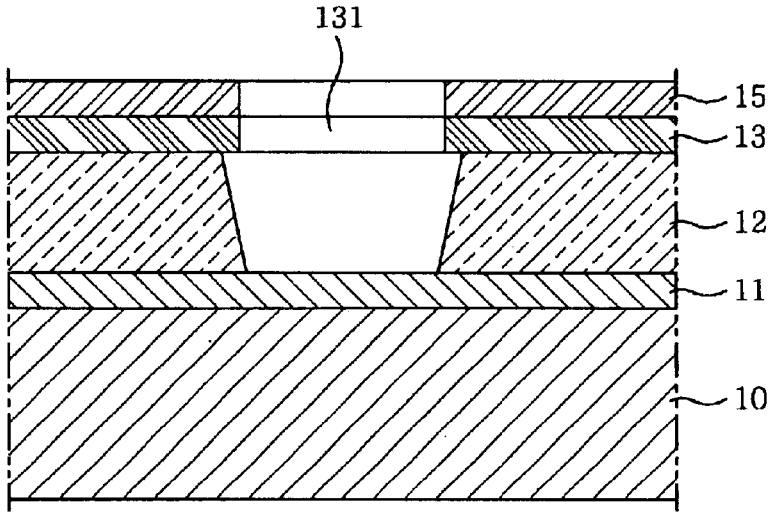
FIG. 4C (PRIOR ART)
Figure 4D:
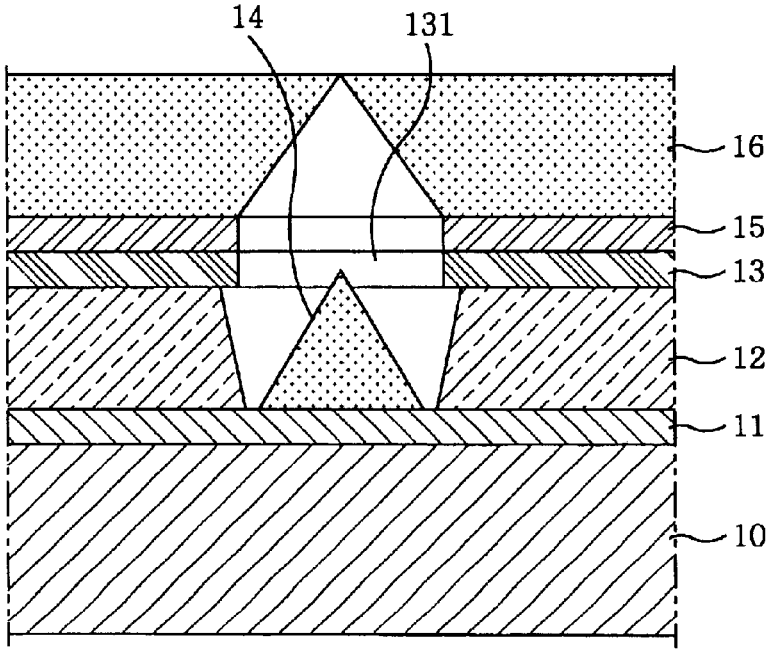
FIG. 4D (PRIOR ART)
Figure 4E:
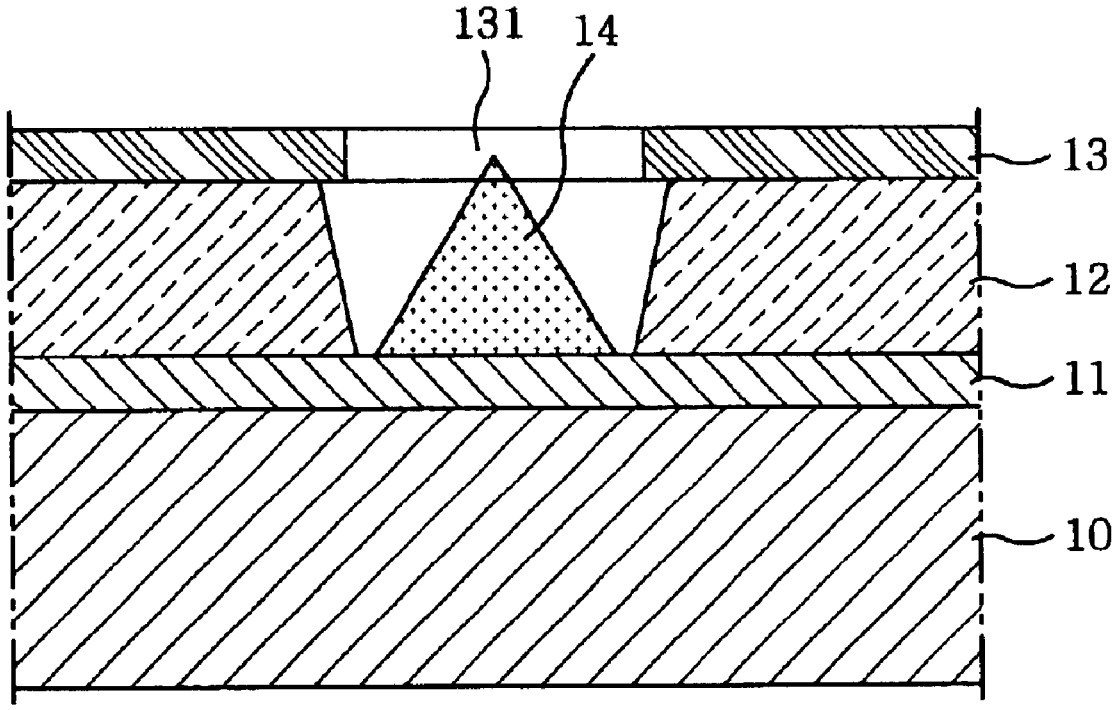
FIG. 4E (PRIOR ART)

FIG. 2 illustrates a schematic cross sectional view of the field emission element fabricated in accordance with the preferred embodiment of the present invention shown in FIGS. 1A to 1G.

As shown in FIG. 1A, a first insulating layer 31 is deposited by a CVD (chemical vapor deposition) method, a sputtering method, or a spin coating method on the surface of a cathode conductor 21 formed on a substrate 1 made of, e.g., glass, wherein the cathode conductor 21 is made of Nb, Mo or Al. Then, a photo resist layer (not shown) is formed on the first insulating layer 31, and patterned for a gate hole 5 by a photomask aligner. Next, the gate hole 5 is provided by etching the first insulating layer 31 by using the patterned photoresist layer as a mask as shown in FIG. 1B. The thickness of the first insulating layer 31 is about 0.2 $\mu$m, and the diameter of the gate hole 5 is about 1.0~1.3 $\mu$m.

In the ensuing step, as depicted in FIG. 1C, a second insulating layer 32 is deposited on the first insulating layer 31 and on the cathode conductor 21 exposed in the bottom portion of the gate hole 5 by the CVD, the sputtering or the spin coating method. The first and second insulating layers 31, 32 are made of SiN, SiOx or SiOF, in which a thickness of the second insulating layer 32 on the first insulating layer 31 is about 0.3 $\mu$m, and that on a side surface of the gate hole 5 is about 0.2 $\mu$m.

In the subsequent step, as illustrated in FIG. 1D, Nb or Mo is deposited on the second insulating layer 32 by an oblique vapor deposition to form a gate 22 thereon. Then, Ni or Al is deposited on the gate 22 by the oblique vapor deposition to form a peeling layer 6 thereon as shown in FIG. 1E. By employing the oblique vapor deposition method when forming the gate 22 and the peeling layer 6, Nb, Mo, Ni and Al are prevented from being deposited on the bottom portion of the gate hole 5. Nevertheless, the Nb, Mo, Ni and Al may get deposited on the side surface of the gate hole 5 but can be removed therefrom when removing the peeling layer 6. Further, the gate 22 and the peeling layer 6 can be formed consecutively in a same chamber.

Subsequently, as illustrated in FIG. 1F, the second insulating layer 32 on the cathode conductor 21 exposed in the bottom portion in the gate hole 5 is removed through the use of an anisotropy dry etching such as an RIE (reactive ion etching). The peeling layer 6 serves as a mask during the RIE etching, and protects the gate 22 and the second insulating layer 32 from any damages that may incur from etching. In other words, since the second insulating layer 32 exposed in the bottom portion of the gate hole 5 is removed after the formation of the peeling layer 6, the peeling layer 6 further serves as an etching mask as well as a peeling layer. Therefore, in the preferred embodiment, the step of removing the second insulating layer 32 exposed in the bottom portion of the gate hole 5 can be performed without having to form an etching mask therefor.

Thereafter, the material of an emitter 4, e.g., Mo, is deposited on the peeling layer 6 and on the cathode conductor 21 in the gate hole 5 through the use of a vertical vapor deposition to form a Mo layer 7 and the conical emitter 4, respectively, as shown in FIG. 1G. Subsequently, the peeling layer 6 is removed to complete the formation of a field emission element as illustrate in FIG. 2.

After the patterning step by the photomask aligner (FIG. 1B), the diameter of the gate hole 5 is nearly equal to a diameter d1, but subsequent to the formation of the second insulating layer 32, the diameter of the gate hole 5 diameter is reduced to a diameter d2 by twice the thickness S1 of the second insulating layer 32 on the side surface of the gate hole 5. In this preferred embodiment, the diameter d1 is about 1.0~1.3 $\mu$m and the thickness S1 of the second insulating layer 32 on the side surface of the gate hole 5 is about 0.2 $\mu$m, resulting in the diameter d2 being in the range from about 0.6 to 0.9 $\mu$m. Therefore, even in a case of forming the gate hole 5 by employing the photomask aligner, the final diameter of the gate hole 5 becomes less than 1 $\mu$m, which is smaller by 0.4 $\mu$m than that conventionally formed by the photomask aligner.

As the diameter of the gate hole 5 is reduced, the height of emitter 4 is also reduced, which may be compensated by reducing the height (or thickness) of the insulating layers between the cathode conductor 21 and the gate 22. However, such reduction in the height (or thickness) of the insulating layers leads to a rise in the electrostatic capacity between the cathode conductor 21 and the gate 22, resulting in a rise of the reactive power. The problem of reactive power may be addressed by selecting the insulating materials with lower dielectric constants, and thereby lowering the reactive power. However, in general an insulating material with a low dielectric constant has a problem of low breakdown voltage. Thus, by lowering the dielectric constants of the insulating layers, the breakdown voltage is lowered.

Therefore, to overcome such problems relating to the reactive power and the breakdown voltage, the preferred embodiment embodies the following features: First, the first insulating layer 31 is made of a material of a lower dielectric constant, and thus reducing the reactive power. Second, the second insulating layer 32 is formed with a material of a higher dielectric constant, covering the horizontal surface of the first insulating layer 32 and the side surface of the gate hole 5; and the thickness (0.3 $\mu$m) of the second insulating layer 32 on the horizontal surface of the first insulating layer 31 is greater than that (0.2 $\mu$m) of the first insulating layer 31, thereby raising the breakdown voltage. That is, the problem relating to the reactive power and the breakdown voltage is overcome by forming a double insulating layers, i.e., the first and the second insulating layers 31 and 32, between the cathode conductor 21 and the gate 22, and by controlling the dielectric constants and the thicknesses of the two insulating layers 31, 32.

In this preferred embodiment, SiN (dielectric constant: 6.0), $SiO_x$ (dielectric constant: 3.9~4.0) and SiOF (dielectric constant: 3.0~3.8) can be used for the two insulating layers 31 and 32. For example, the first insulating layer 31 can be made of SiOF and the second insulating layer 32 can be made of SiN. Further, alternative materials can be chosen for the insulating layers 31 and 32, and even the identical materials with varying conditions or methods for forming such insulating layers can be used, thereby providing different dielectric constants for the insulating layers.

Figure 5:
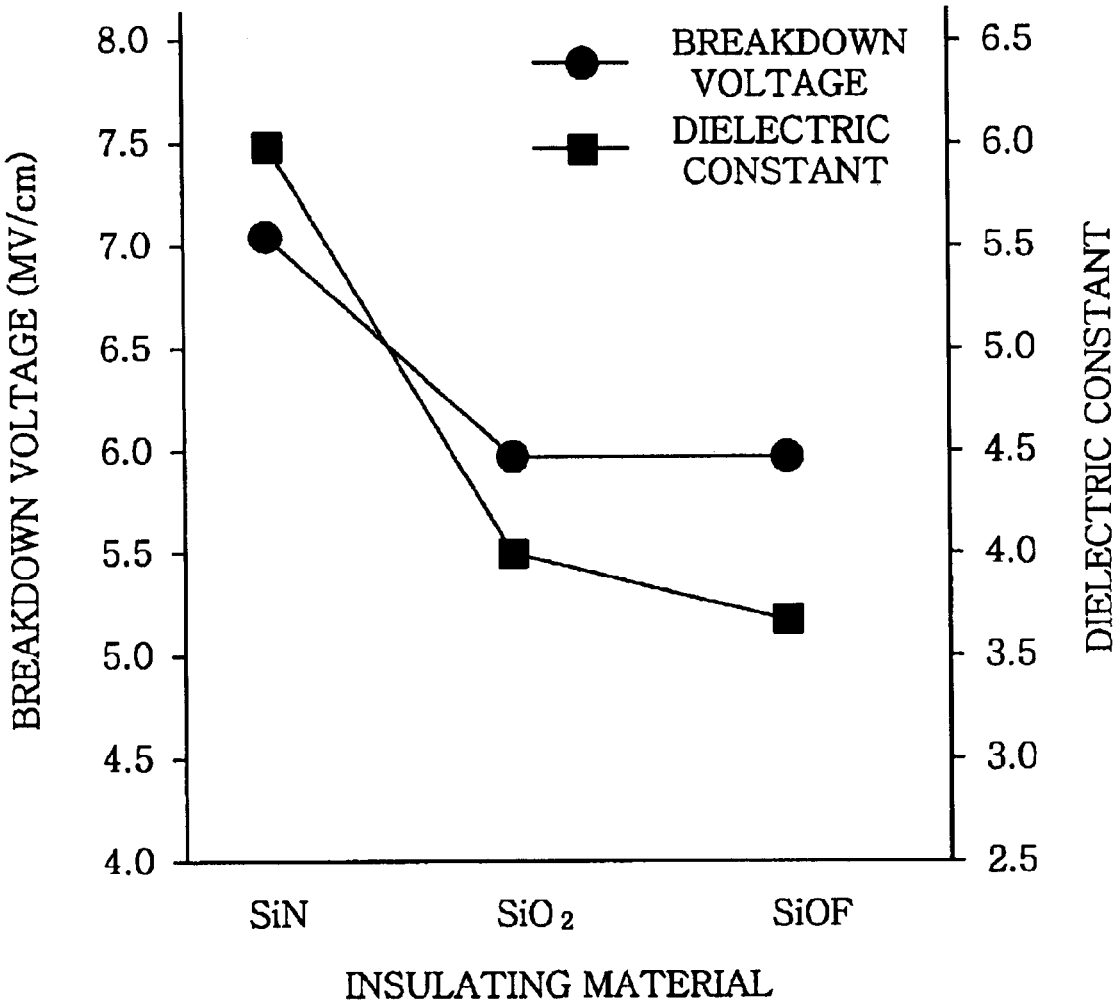
FIG. 5 sets forth plotted dielectric constants and the breakdown voltages of silicon based insulating materials formed into layers by the CVD process.

In addition, the combination of the materials for the first and the second insulating layers 31 and 32 is not limited to that described above. With such different combination of materials, the dielectric constant of a material for the second insulating layer 32 can be made higher than that for the first insulating layer 31, in which case the reactive power between the cathode conductor 21 and the gate 22 is reduced, so that the breakdown voltage is raised. Additionally, when materials, such as $SiO_2$ and SiOF, that are nearly equal in the breakdown voltage but have different dielectric constants as shown in FIG. 5 are chosen for the first and second insulating layers 31 and 32, the breakdown voltage may be held constant while the reactive power is varied. Moreover, by forming the second insulating layer 32 in a manner described above, the diameter of the gate hole 5 can be reduced.

The field emission element of the present invention includes an insulating layer structure having two layers, and the upper insulating layer of the two-layer structure covers the side surface of the gate hole. Moreover, by selecting a material with higher dielectric constant for the upper layer, the reactive power between the gate and the cathode conductor can be lower and the breakdown voltage therebetween can be higher in comparison with a single-layer insulating structure. Therefore, when the field emission element of the present invention is used for a field emission display, the driving voltage applied to the cathode conductor and the gate can decline by reducing the diameter of the gate hole and the distance between the gate and the tip of the emitter. In addition, by reducing the diameter of the gate hole, the emitter density (the number of the emitters per unit area) can be increased which results in a further reduction of the driving voltage.

The method for manufacturing a field emission element of the present invention includes a step of forming the second insulating layer (or the upper layer) after photolithographically forming the gate hole in the first insulating layer through the use of photomask aligner. As a result, the diameter of the gate hole can be made less than that of the conventionally formed by the photolithography. Moreover, using the second insulating layer also solves the problems regarding the reactive power and the breakdown voltage. In other words, the second insulating layer can also serve to compensate for the reduction of the breakdown voltage due to the use of the first (or lower) insulating layer employed for the reduction of the reactive power.

Furthermore, the method for manufacturing a field emission element in accordance with the present invention includes a step of removing the second insulating layer deposited on the bottom portion of the gate hole after forming the peeling layer on the second insulating layer. Therefore, the peeling layer further serves as an etching mask as well as a peeling layer. As a result, a need for a mask during the removal of the second insulating layer is eliminated, and thereby simplifying the manufacturing process.

While the invention has been shown and described with respect to the preferred embodiments, it will be understood by those skilled in the art that various changes and modifications may be made without departing from the spirit and scope of the invention as defined in the following claims.

What is claimed is:

1. A field emission element, comprising:

a substrate made of an insulating material;

a cathode conductor disposed on the substrate;

an insulating layer structure disposed on the cathode conductor wherein the insulating layer structure includes a first insulating layer formed on the cathode conductor and a second insulating layer formed on the first insulating layer;

a gate disposed on the second insulating layer;

a gate hole provided through the gate and the insulating layer structure to expose a portion of the cathode conductor therethrough; and an emitter of a conical shape formed on the exposed portion of the cathode conductor in the gate hole, wherein the first insulating layer is covered by the second insulating layer at a side surface of the gate hole and a dielectric constant of the first insulating layer is different from that of the second insulating layer.

2. The field emission element of claim 1, wherein the dielectric constant of the second insulating layer is greater than that of the first insulating layer.

3. The field emission element of claim 1, wherein a thickness of the second insulating layer located between the gate and the first insulating layer is greater than that of the first insulating layer.

4. A field emission display, comprising:

a field emission element, including:

a substrate made of an insulating material;

a cathode conductor disposed on the substrate;

an insulating layer structure disposed on the cathode conductor wherein the insulating layer structure includes a first insulating layer formed on the cathode conductor and a second insulating layer formed on the first insulating layer;

a gate disposed on the second insulating layer;

a gate hole provided through the gate and the insulating layer structure to expose a portion of the cathode conductor therethrough; and an emitter of a conical shape formed on the exposed portion of the cathode conductor in the gate hole, wherein the first insulating layer is covered by the second insulating layer at a side surface of the gate hole and a dielectric constant of the first insulating layer is different from that of the second insulating layer.

5. A method for manufacturing a field emission element, comprising the steps of:

forming a cathode conductor on a substrate made of an insulating material;

forming a first insulation layer on the cathode conductor;

providing a gate hole in the first insulating layer, the cathode conductor being exposed through the gate hole;

forming a second insulating layer on the first insulating layer, the cathode conductor exposed in a bottom portion of the gate hole and a side surface of the gate hole;

forming a gate on the second insulating layer outside the gate hole;

forming a peeling layer on the gate;

removing the second insulating layer on the cathode conductor exposed in the bottom portion of the gate hole;

forming a conical emitter by depositing a material for the emitter on the peeling layer and on the cathode conductor in the gate hole; and removing the peeling layer, wherein a dielectric constant of the second insulating layer is different from that of the first insulating layer.

6. The method of claim 5, wherein the dielectric constant of the second insulating layer is greater than that of the first insulating layer.

7. The method of claim 5, wherein a thickness of the second insulating layer located between the gate and the first insulating layer is greater than that of the first insulating layer.

* * * * *